US005114255A

United States Patent [19]

Villarreal

[11] Patent Number: 5,114,255

[45] Date of Patent: May 19, 1992

[54] APPLICATOR BRUSH ASSEMBLY

[76] Inventor: Jose R. Villarreal, P.O. Box 923, Pearsall, Tex. 78061

[21] Appl. No.: 597,542

[22] Filed: Oct. 15, 1990

[51] Int. Cl.[5] ..... A46B 11/04; B05L 1/06; B05L 17/00

[52] U.S. Cl. ..... 401/45; 401/206; 401/207; 401/266; 401/278; 15/230.16; 15/244.1

[58] Field of Search ..... 401/263, 270, 279, 278, 401/205, 206, 207, 289, 266, 27, 24, 44–47, 286, 288, 268; 15/230.16, 230.18, 230, 244.1

[56] References Cited

U.S. PATENT DOCUMENTS

| | | | |
|---|---|---|---|
| 1,217,054 | 2/1917 | Pearman | 401/206 |
| 1,220,506 | 3/1917 | Eickmier | 401/278 |
| 1,226,520 | 5/1917 | Huether | 401/278 |
| 1,972,318 | 9/1934 | Rosenberg | 401/206 |
| 2,147,769 | 2/1939 | Epstein | 401/266 X |
| 2,314,394 | 3/1943 | Guy | 401/278 X |
| 2,636,203 | 4/1953 | Glantz | 401/278 |
| 2,668,306 | 2/1954 | Kohl | 401/206 |
| 2,710,981 | 6/1955 | Sterert | 401/263 |
| 3,641,610 | 2/1972 | Lewis | 401/24 X |
| 3,737,938 | 6/1973 | Saltzstein | 401/207 X |
| 4,236,840 | 12/1980 | Kennedy | 401/270 X |
| 4,859,102 | 8/1989 | Chamieh | 401/24 X |

FOREIGN PATENT DOCUMENTS

| | | | |
|---|---|---|---|
| 2310812 | 1/1977 | France | 401/207 |
| 237595 | 9/1945 | Switzerland | 401/206 |
| 990142 | 4/1965 | United Kingdom | 15/230.16 |

*Primary Examiner*—Danton D. DeMille
*Attorney, Agent, or Firm*—Leon Gilden

[57] ABSTRACT

An apparatus including a housing, with a through-extending aperture directed laterally of the housing, with the housing defining a cavity accessed through a fill spout. The housing includes a selectively mounted first cup-shaped pad member, with a plunger operative through an upper surface of the housing to direct fluid from interiorly of the cavity of the housing to the cup-shaped pad member. A further cup-shaped pad member may be utilized defined by a sinusoidal bottom surface, including cup-shaped troughs defined by a predetermined depth, with each of the troughs including a matrix of bristles defined by a length less than the predetermined depth to enhance cleaning in use. Further, a modification of the invention includes a partition wall, with the partition wall dividing the housing cavity into a plurality of separate chambers, each selectively operative through an associated plunger to direct fluid into an underlying pad member.

1 Claim, 5 Drawing Sheets

PRIOR ART

APPLICATOR BRUSH ASSEMBLY

BACKGROUND OF THE INVENTION

1. Field of the Invention

The field of invention relates to brush organizations, and more particularly pertains to a new and improved applicator brush assembly wherein the same includes a housing defining a cavity accessed through a fill spout to enhance cleaning.

2. Description of the Prior Art

The prior art has utilized brush organizations that permit a cleaning fluid and the like to be directed into an underlying brush assembly. Such U.S. patents include U.S. Pat. No. 1,476,610 to Herbert, et al. wherein a brush member includes an overlying housing permitting fluid to be directed through the housing by a manually operative plunger.

U.S. Pat. No. 1,281,660 to Replogle sets forth a brush assembly mounted underlying a housing, wherein the brush assembly includes an internal cavity in the housing that directs a fluid medially through a bottom surface of the housing.

U.S. Pat. No. 4,312,598 to Vagner sets forth a cleaning assembly, wherein plunger and spring positioned medially of a cleaning member is displaced to direct fluid to cleaning assemblies.

U.S. Pat. No. 1,165,208 to Ricard sets forth an elongate handle that is operative to direct fluid from the reservoir contained within the handle to a bristle brush matrix assembly mounted to a support block in fluid communication of the handle.

U.S. Pat. No. 4,826,340 to Rothweiler, et al. sets forth a hand brush utilizing a manually displaceable valve to direct a liquid discharged form the handle into an underlying bristle brush matrix.

As such, it may be appreciated that there continues to be a need for a new and improved applicator brush assembly as set forth by the instant invention which addresses both the problems of ease of use as well as effectiveness in construction in directing a cleaning fluid to a pad organization and in this respect, the present invention substantially fulfills this need.

SUMMARY OF THE INVENTION

In view of the foregoing disadvantages inherent in the known types of applicator brush constructions now present in the prior art, the present invention provides an applicator brush assembly wherein the same utilizes a reservoir mounted within a housing to direct cleaning fluid to an underlying cup-shaped pad assembly selectively and removably mounted to a bottom surface of the housing. As such, the general purpose of the present invention, which will be described subsequently in greater detail, is to provide a new and improved applicator brush assembly which has all the advantages of the prior art applicator brush members and none of the disadvantages.

To attain this, the present invention provides an apparatus including a housing, with a through-extending aperture directed laterally of the housing, with the housing defining a cavity accessed through a fill spout. The housing includes a selectively mounted first cup-shaped pad member, with a plunger operative through an upper surface of the housing to direct fluid from interiorly of the cavity of the housing to the cup-shaped pad member. A further cup-shaped pad member may be utilized defined by a sinusoidal bottom surface, including cup-shaped troughs defined by a predetermined depth, with each of the troughs including a matrix of bristles defined by a length less than the predetermined depth to enhance cleaning in use. Further, a modification of the invention includes a partition wall, with the partition wall dividing the housing cavity into a plurality of separate chambers, each selectively operative through an associated plunger to direct fluid into an underlying pad member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved applicator brush assembly which has all the advantages of the prior art applicator brush members and none of the disadvantages.

It is another object of the present invention to provide a new and improved applicator brush assembly which may be easily and efficiently manufactured and marketed.

It is a further object of the present invention to provide a new and improved applicator brush assembly which is of a durable and reliable construction.

An even further object of the present invention is to provide a new and improved applicator brush assembly which is susceptible of a low cost of manufacture with regard to both materials and labor, and which accordingly is then susceptible of low prices of sale to the consuming public, thereby making such applicator brush assemblies economically available to the buying public.

Still yet another object of the present invention is to provide a new and improved applicator brush assembly which provides in the apparatuses and methods of the prior art some of the advantages thereof, while simultaneously overcoming some of the disadvantages normally associated therewith.

Still another object of the present invention is to provide a new and improved applicator brush assembly wherein the same utilizes a manually displaceable plunger to direct cleaning fluid to a pad and brush assembly matrix to enhance a cleaning procedure by the cleaning fluid utilized.

These together with other object of the invention, along with the various features of novelty which characterize the invention, are pointed out with particularity in the claims annexed to and forming a part of this diclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is an orthographic view, taken along the lines 10—10 of FIG. 9, in the direction indicated by the arrows.

DESCRIPTION OF THE PREFERRED EMBODIMENT

Figure 1:
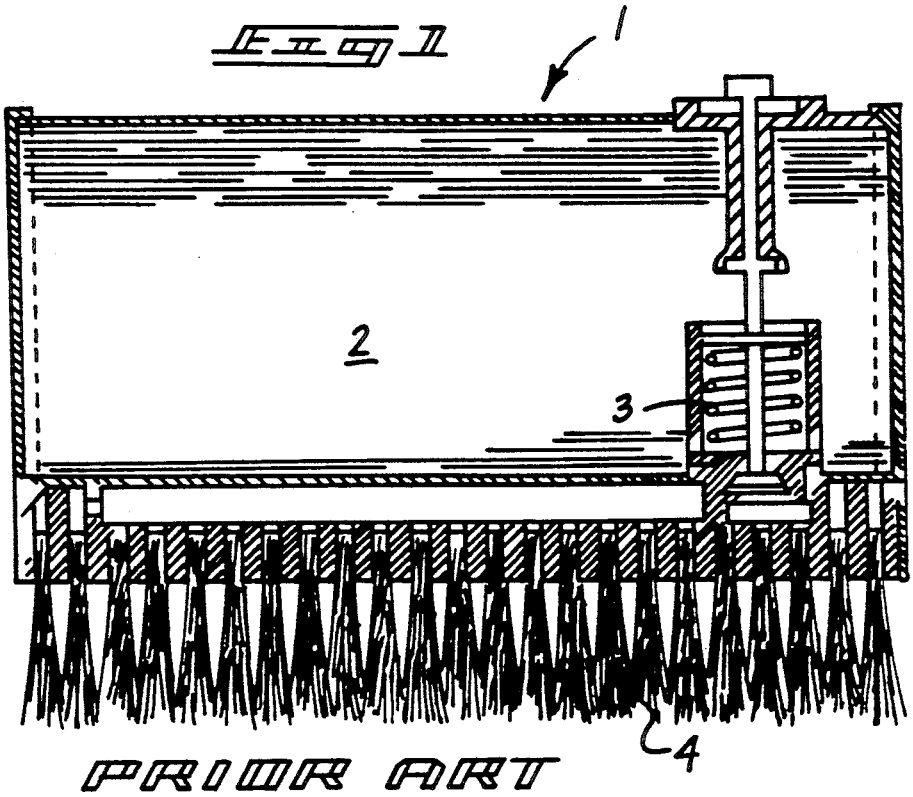
FIG. 1 is an orthographic cross-sectional illustration of a prior art brush assembly.

With reference now to the drawings, and in particular to FIGS. 1 to 10 thereof, a new and improved applicator brush assembly embodying the principles and concepts of the present invention and generally designated by the reference numeral 10 will be described.

Figure 2:
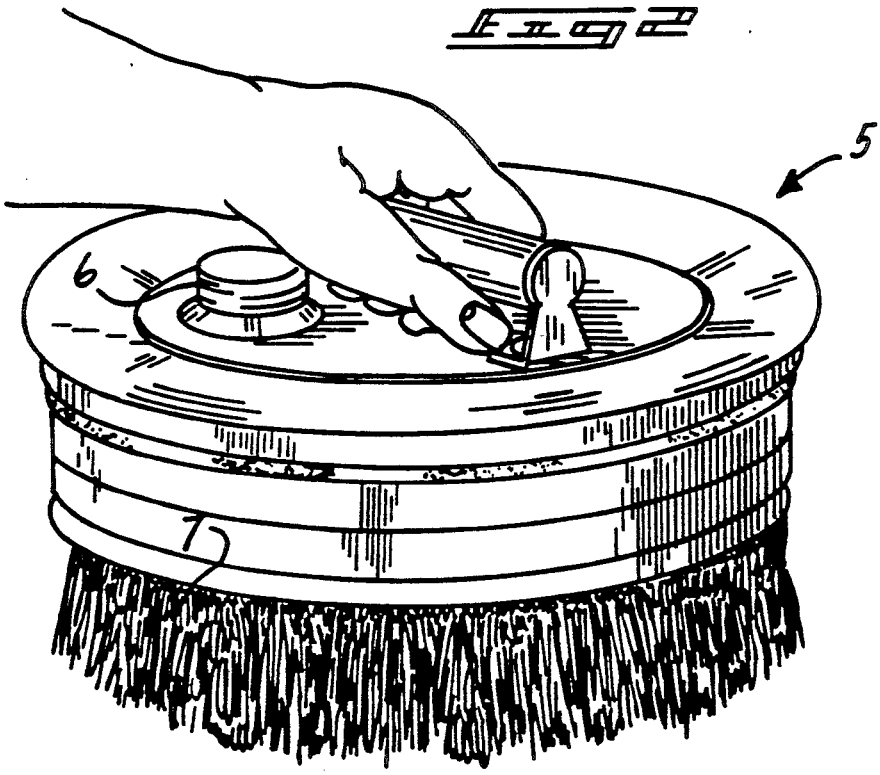
PRIOR ART FIG 2
FIG. 2 is an isometric illustration of a further example of a prior art brush assembly.
Figure 3:
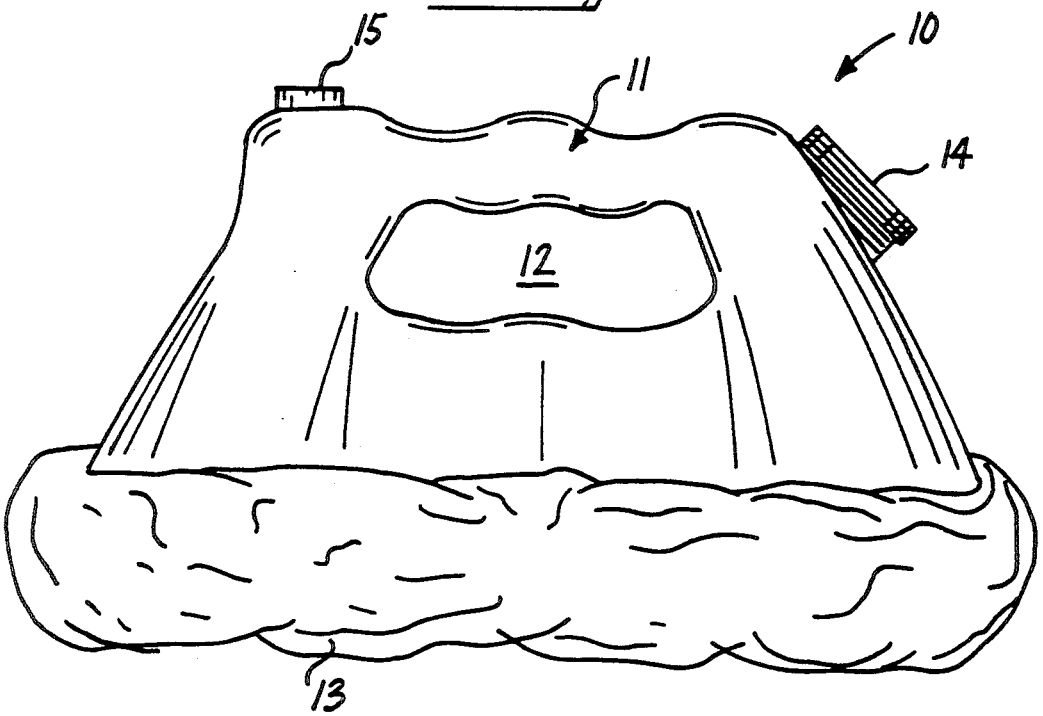
FIG. 3 is an orthographic side view, taken in elevation, of the instant invention.

FIG. 1 illustrates a prior art brush assembly 1, wherein a housing includes a cavity 2 to permit directing of cleaning fluid through a valve member, including a spring and plunger 3 to direct a cleaning fluid to an underlying bristle brush matrix 4, in a manner as set forth in U.S. Pat. No. 1,746,610. FIG. 2 illustrates a further prior art brush assembly 5, wherein a housing includes a fill cap 6 to direct fluid into an underlying bristle brush matrix 7 through a central delivery port, in a manner as set forth in U.S. Pat. No. 1,281,660.

Figure 4:
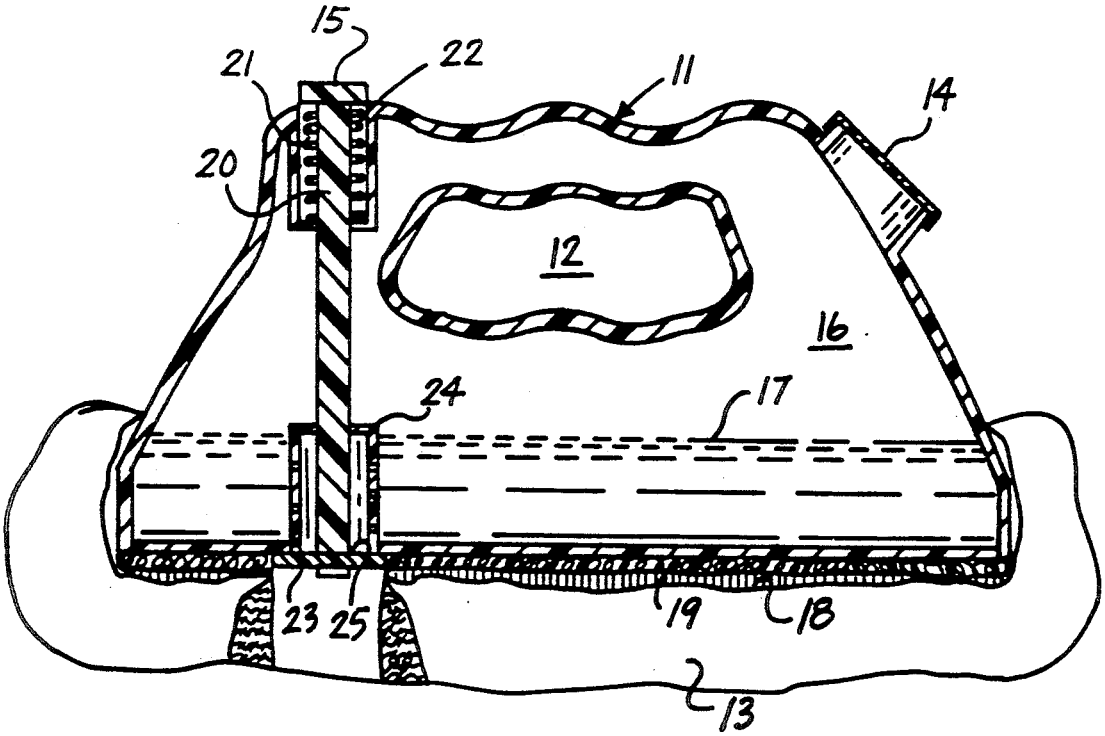
FIG. 4 is an orthographic cross-sectional illustration of the instant invention.
Figure 5:
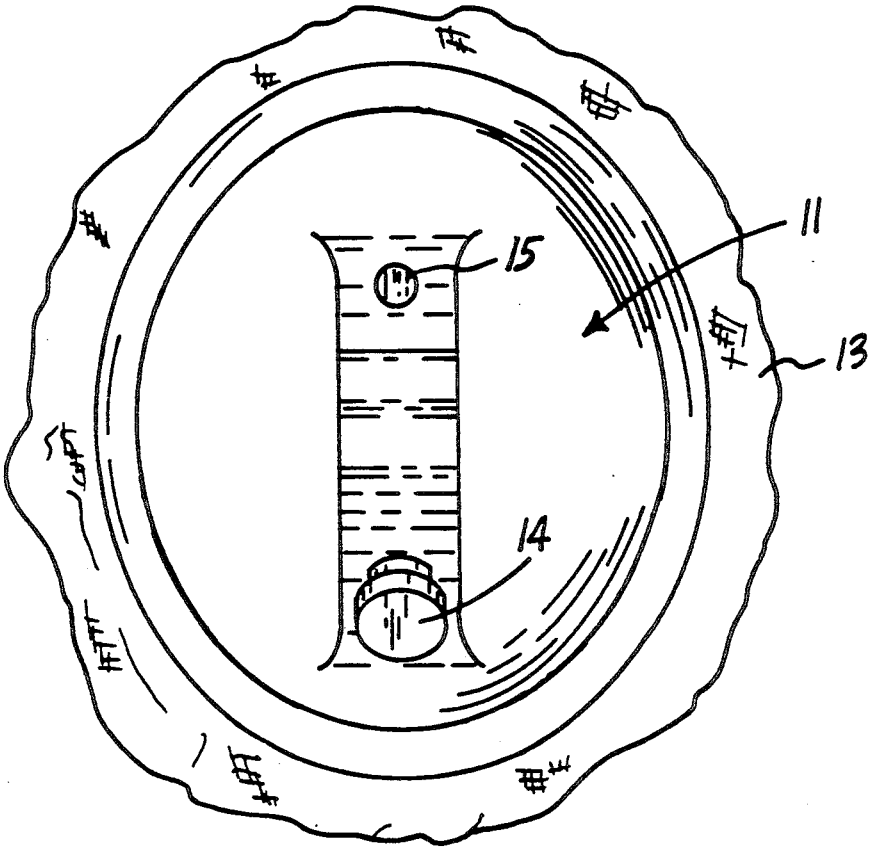
FIG. 5 is an orthographic top view of the instant invention.
Figure 6:
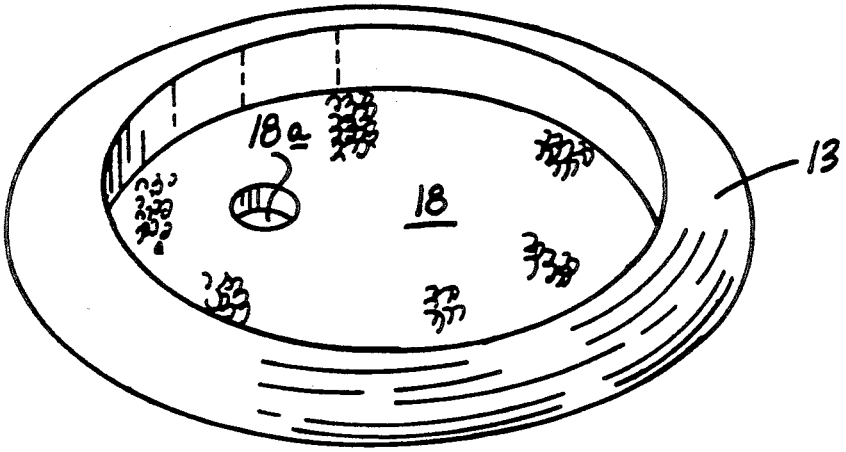
FIG. 6 is an isometric illustration of a first cup-shaped pad member utilized by the organization of the invention.

More specifically, the applicator brush assembly 10 of the instant invention essentially comprises a hollow housing 11, including an elongate opening 12 directed laterally through the housing to define a handle. A cup-shaped fluid observant pad 13 is mounted to a bottom surface of the housing 11, as illustrated. The pad 13 is formed with an annular skirt mounted about a lower peripheral portion of the housing, with a floor for securement to the bottom surface of the housing. The floor of the pad 13 includes a first hook and loop fastener surface 18 selectively securable to a second hook and loop fastener surface 19 mounted coextensively to a bottom surface of the housing 11, as illustrated in FIGS. 4 and 6 for example. The housing includes a removable cap 14 mounted mechanically to a fill spout utilizing either a threaded or interference connection therebetween. A plunger head 15 projects exteriorly through the top surface of the housing adjacent the handle and is mounted to an upper terminal end of a plunger rod 20. A spring 21 is captured between a bottom surface of the plunger head 15 and a floor of an assoicated spring well 21, with the rod 20 and spring 22 coaxially positioned within the well 21. The housing 11 includes a housing cavity 16, including a predetermined quantity of fluid defining a fluid reservoir 17 therewithin. The fluid reservoir 17 surrounds an associated apertured metering housing 24 in surrounding relationship relative to a lower portion of the rod 20. A resilient plug member 23 mounted to a lower terminal end of the rod 20 is displaced relative to an associated floor opening 25 to permit fluid to be directed through the apertured metering housing 24 and into the cup-shaped pad 13 for application to a surface to be cleaned. The floor of the cup-shaped pad, including the first hook and loop fastener surface 18, includes a through-extending pad floor opening **18*a* coaxially aligned with the floor opening 25** to permit direct application of fluid onto a surface to be cleaned, as well as into the pad during its use.

Figure 7:
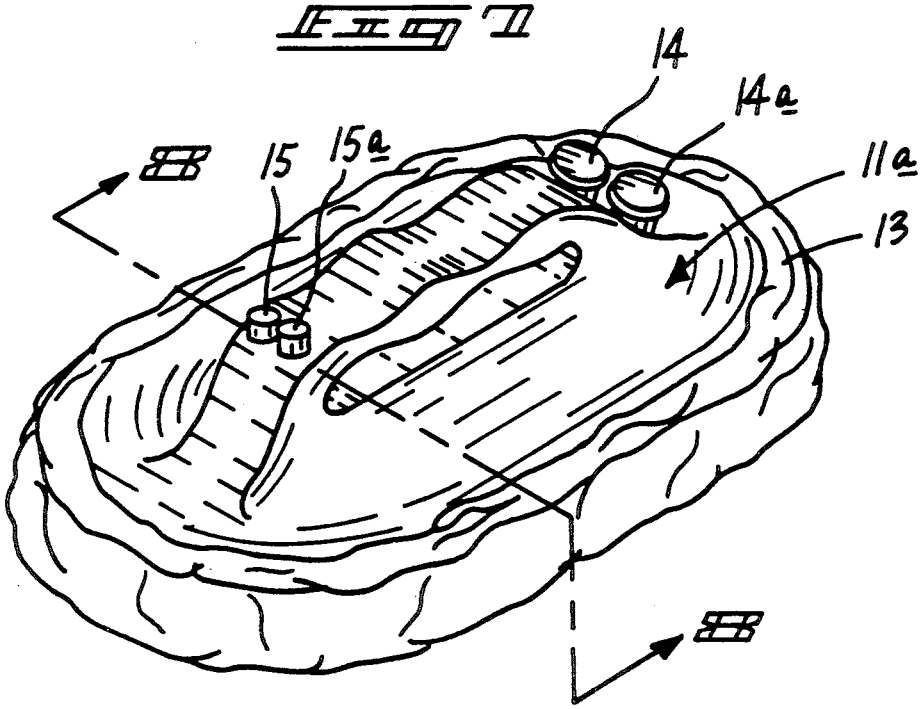
FIG. 7 is an isometric illustration of a modified brush assembly utilized by the instant invention.
Figure 8:
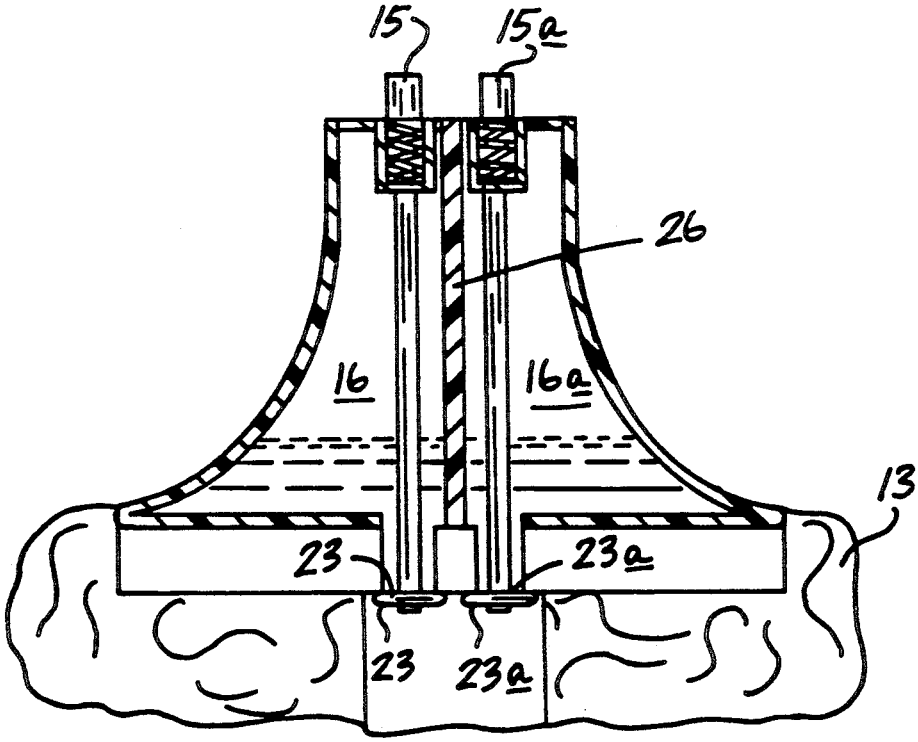
FIG. 8 is an orthographic view, taken along the lines 8—8 of FIG. 7, in the direction indicated by the arrows.

FIG. 7 illustrates a modified housing **11*a*, with the use of a further cap 14*a* and fill spout cooperating with a further plunger head 15*a*, in a manner as illustrated in FIG. 8, wherein a partition wall 26 divides the housing cavity 16 from a further housing cavity 16*a* to permit application of selective fluids during a cleaning procedure, depending upon a particular surface to be cleaned, requiring for example a cleaner and subsequent wax application fluid to be utilized in the respective housing cavity 16 and the further housing cavity 16*a*** during use.

Figure 9:
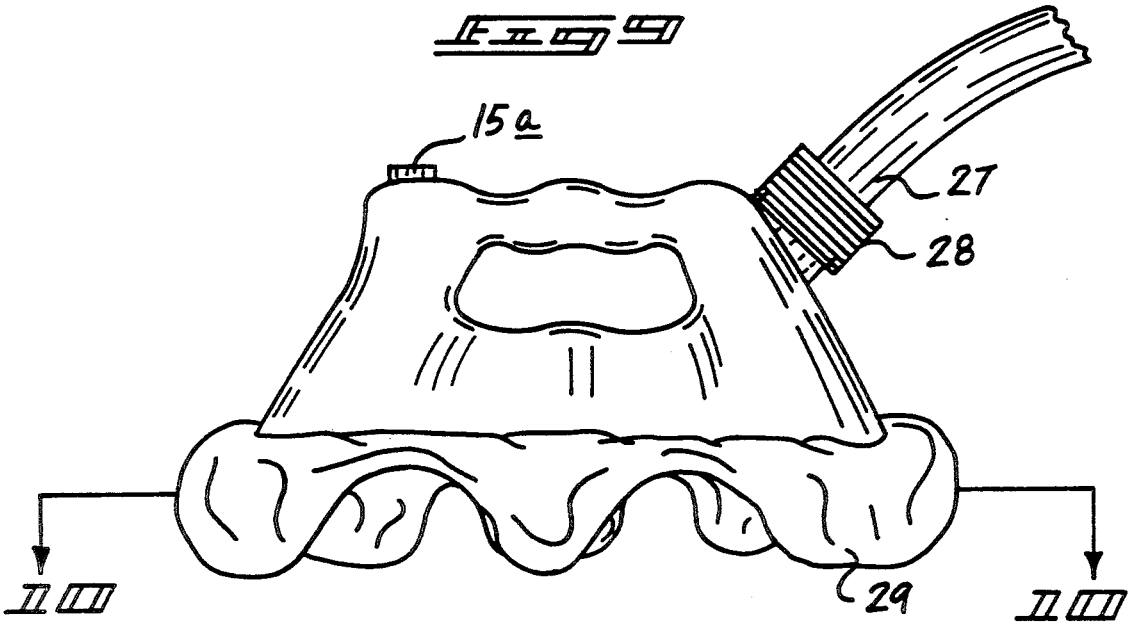
FIG. 9 is an orthographic side view, taken in elevation, of a further pad assembly utilized by the instant invention in association with a supply of fluid under pressure.
Figure 11:
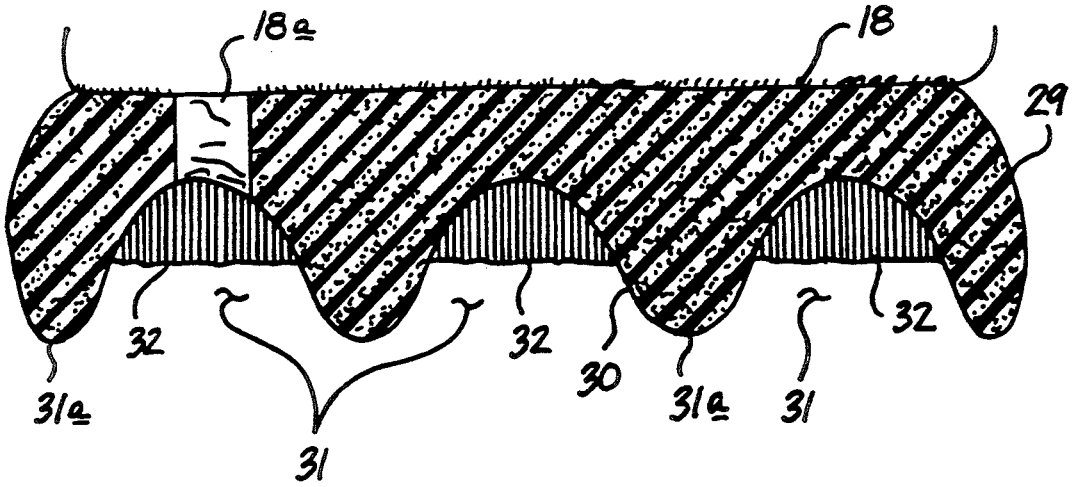

FIG. 9 illustrates the organization in combination with a water conduit 27, including a water conduit connector head 28 threadedly mounted to the fill spout. A further pad member 29 is provided formed of a fluid absorbent material, such as a polymeric type sponge material, that includes a sinusoidal bottom surface 30 defining a plurality of cup-shaped troughs 31 defined between projections **31*a*. Each trough 31 is defined by a predetermined depth that includes a bristle brush matrix assembly 32 mounted within each trough, wherein each bristle brush matrix defined by a predetermined length less than the predetermined depth of each trough, such that upon application of pressure to the further pad member 29, the bristle brush matrix assemblies 32 will engage a surface to be cleaned for enhanced cleaning. It should be noted that the cup-shaped pad member 29 is also provided with a first hook and loop fastener surface 18 for securement to the second hook and loop fastener surface 19 of the housing 11**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An applicator brush assembly comprising, in combination, a hollow housing, the housing including a top surface and a bottom surface, and including a housing cavity defined within the housing, and at least one fill spout and removable cap directed through the housing in fluid communication with the cavity, and a flow absorbent cup-shaped pad mounted to the bottom surface of the housing, with the pad including a pad floor and an annular skirt projecting above the floor, the annular skirt arranged in surrounding relationship relative to a lower portion of the housing, and a plunger well positioned within the top surface of the housing, and a plunger head projecting exteriorly of the plunger well, and a spring captured between the plunger head and a floor of the well, and a plunger rod fixedly mounted to the plunger head and extending through the housing and into an apertured metering housing, the metering housing mounted within a floor opening directed through the bottom surface of the housing, and a plug member mounted to a lower terminal end of the plunger rod overlying the floor opening wherein upon depressing of the plunger head displaces the plug member relative to the floor opening to permit directing of fluid within the cavity exteriorly of the cavity and into the cup-shaped pad, and wherein the cup-shaped pad includes a pad floor opening coaxially aligned with the floor opening of the housing, and wherein the floor of the cup-shaped pad coextensively therewith includes a first hook and loop fastener surface, and the bottom surface of the housing coextensively therewith includes a second hook and loop fastener surface, wherein the first and second hook fastener surfaces are selectively securable together to secure the pad to the housing, and including a partition wall coextensively formed throughout the housing to define the cavity and a further cavity, the further cavity including a further fill spout in fluid communication with the further cavity and further removable cap mounted to the further fill spout, and including a further plunger head mounted within a further plunger well, and the further plunger well positioned within the top wall of the housing spaced from the plunger well and mounting the further plunger head in cooperation with a further resilient plug member cooperative with a further floor opening in fluid communication with the further cavity, wherein the cavity and further cavity within the hollow housing each include a respective first and second fluid therewithin, and wherein the cup-shaped pad includes a sinusoidal bottom surface defining a plurality of troughs therewithin, each of the plurality of troughs including a plurality of projections in surrounding relationship to each trough, and each trough is defined by a predetermined depth, and a bristle brush matrix assembly is fixedly mounted within each trough, and each bristle brush matrix assembly is defined by a predetermined length, and the predetermined length is less than the predetermined depth, and the projections are deformable to permit access of each bristle brush matrix assembly to a surface to be cleaned upon compression of the projections.

* * * * *